US010111476B2

(12) United States Patent
Tamaribuchi

(10) Patent No.: US 10,111,476 B2
(45) Date of Patent: Oct. 30, 2018

(54) ERGONOMIC GRIPPING ACTIVITIES GLOVE

(75) Inventor: Stephen K. Tamaribuchi, Sacramento, CA (US)

(73) Assignee: BioGrip, Inc., Sacramento, CA (US)

( * ) Notice: Subject to any disclaimer, the term of this patent is extended or adjusted under 35 U.S.C. 154(b) by 473 days.

(21) Appl. No.: 13/506,558

(22) Filed: Apr. 27, 2012

(65) Prior Publication Data

US 2013/0283497 A1 Oct. 31, 2013

(51) Int. Cl.
*A41D 19/015* (2006.01)

(52) U.S. Cl.
CPC ..... *A41D 19/01547* (2013.01)

(58) Field of Classification Search
CPC ..... A41D 19/01547
USPC ..... 2/16, 20, 160, 161.1, 161.6, 161.8, 167, 2/163; 294/25
See application file for complete search history.

(56) References Cited

U.S. PATENT DOCUMENTS 3,606,614 A * 9/1971 Dimitroff ..... 2/159
4,663,783 A * 5/1987 Obayashi ..... 2/161.1
5,561,856 A * 10/1996 Pesco ..... A41D 19/01588 2/16
6,723,401 B1 * 4/2004 McKnight et al. ..... 428/35.7
2009/0139010 A1 * 6/2009 Bevier ..... 2/161.8
2012/0005805 A1 * 1/2012 Bevier et al. ..... 2/161.1
2015/0189932 A1 * 7/2015 Champagne ..... A41D 19/0096 2/161.6

* cited by examiner

*Primary Examiner* — Katherine Moran
(74) *Attorney, Agent, or Firm* — Sheppard, Mullin, Richter & Hampton LLP

(57) ABSTRACT

An ergonomic glove, fingered or fingerless, is provided for use with devices that require gripping such as ski poles, dumbbells, and bicycle handlebars. The glove shape is of a sports-fitted glove with built-up areas on the thumb, fingers, and palm, whereby when the wearer grips an item, the thumb is supported and the hand and wrist are in a neutral position generally aligned with the forearm. A thumb retainer is provided to position and support the thumb while bent. The glove is also provided with a padded insert or exsert of two different constructions, both having three portions, which insert or exsert acts to restrict the contraction of the successive fingers at a gradual rate. The insert/exsert causes the knuckles to be in linear alignment. The glove promotes improved alignment and stabilization of the user's body parts and in particular shoulders, hips, legs, etc., for greater stability and movement efficiency.

27 Claims, 6 Drawing Sheets

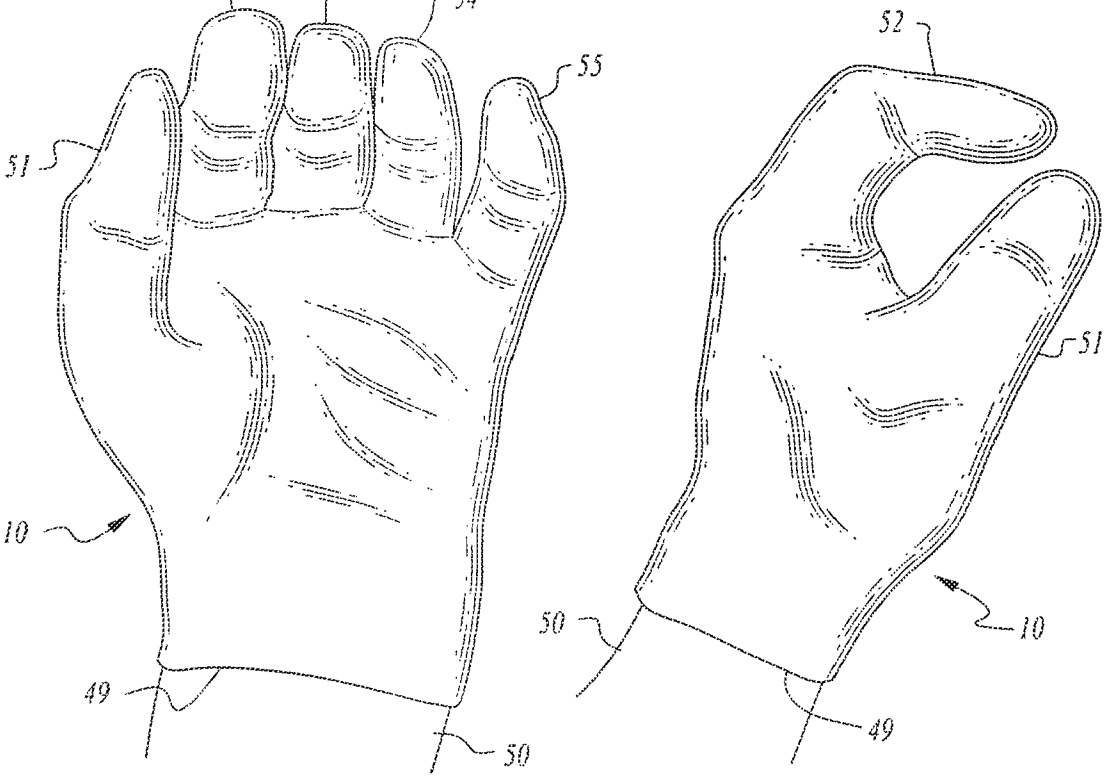
Fig. 5
Fig. 4
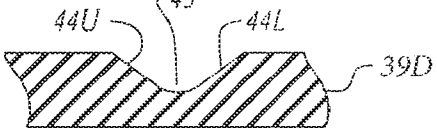
Fig. 3A
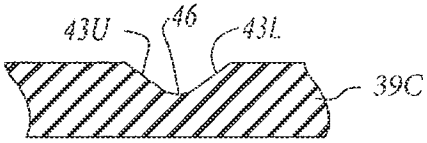
Fig. 3B
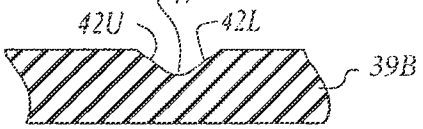
Fig. 3C
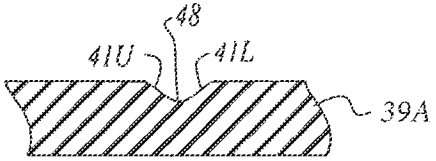
Fig. 3D

ERGONOMIC GRIPPING ACTIVITIES GLOVE

FIELD OF THE INVENTION

This invention relates to a specialized glove used in pairs which permits the user to grip such items as ski poles, hand tools, bicycle handlebars, crutches, and other items that require a gripping motion to do so in a more beneficial ergonomic manner involving specific finger placement. This finger placement positions the user's hand to create optimal skeletal alignment and to perform various physical activities in a more beneficial ergonomic manner.

BACKGROUND OF THE INVENTION

An engineer is a person who is trained or skilled in the designing or planning of the creation of machines and structures and their implementation. The best use of human labor, whether for business or pleasurable activities, falls within the domain of industrial engineering. The interaction of human beings and machines and machinery falls within the domain of human engineering IE ergonomics. Thus it fell upon applicant, who works in the field of ergonomics, to recognize that many routine chores and activities such as rowing, bicycling, lifting boxes or items, pulling/pushing, and other work or play mechanical movements can be done in a more balanced fashion, that is, in an ergonomically, friendly manner. That is, the hands of the party doing an act would not get tired and become strained from excessive use or misuse while performing athletic tasks such as cycling, rowing, and weightlifting. Or work tasks such as lifting, carrying, pushing, and using tools.

The approach to the question of how to carry out everyday chores in a more ergonomic mode was approached not from the viewpoint of changing every tool, instrument, or object that was handled by a user, but rather to adapt the user in a friendly fashion to the preexisting ergonomic unfriendly items that already exist in the world. Thus the question was phrased, "lower the water or raise the bridge?" And so applicant came upon a unique approach of adapting the hands to act in an ergonomic fashion when being applied to preexisting items used every day in the world.

Since applicant could not change every handle, ski pole, oar, etc., the changing of the mode of gripping or articulating the fingers and the hands on such items was undertaken. Thus, the glove of this invention was born.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A glove made of leather or fabric shaped to and sized for the user's hand, insulated or not, and having a specifically configured rubber or other material, such as Kevlar®, nomex, etc. insert designed to change the mode of gripping of a handle, pole, tool or object or bar by the fingers. The thumb has a support to limit its motion and modify its position. The insert and the support are each sewn or glued between the outer layer and the lining of the glove, or under the lining layer wherein direct skin contact would transpire.

It is a first object to provide a new ergonomic glove, the left of which is a mirror image version of the right.

It is a second object to provide a glove that enables the user to grip items in a more ergonomic friendly fashion.

It is a third object to provide a glove that prevents the user from straining their wrist caused by improper lifting of handles, and bars, and improper hand positions during typing of inputting numbers, and during the use of hand tools.

It is a fourth object to provide an ergonomic glove for use in sports, while on the job doing certain tasks, such as using a rake . . . and at play, such as weight lifting to prevent or inhibit wrist injury.

It is a fifth object to provide a glove that supports the thumb in a neutral position.

It is a sixth object to provide a glove that restricts the contraction of the fingers on a graduated basis using grooves of various sizes, or layers of material that may be glued, heat welded, or sewn together, to create a variable resistance.

It is a seventh object to provide a glove that improves the user's biomechanics efficiency.

It is an eighth object to provide a fingerless glove that operates in the same manner as the fingered glove but for different uses. It is a ninth object to provide a glove wherein there is a graduated resistance from pinky to index finger, such that it is easier to contract the little finger, #5, than the ring finger, #4, than the middle finger, #3 with the hardest finger to contract being the index finger, #2, adjacent to the thumb.

Other objects of the invention will in part be obvious and will in part appear hereinafter.

BRIEF DESCRIPTION OF FIGURES

FIG. 3 is a series of four side elevational views of the respective finger segments of the insert of this invention designated 3A-3D inclusive, and showing the change in depth and width of bend crevice for each of the four fingers.

FIG. 4 is a perspective view of the left hand—palmar side—with a glove thereon seen from the palm side showing the restricted movement available when this glove is worn by the user.

FIG. 5 is a side perspective view of the left glove thumb shown in the retained position on the support aspect of this invention.

The term top plan as used herein, refers to the plane of the view. A human hand has two sides, a back side—having the nails—is correctly referred to as the dorsal side. The palm side is technically referred to as the palmar side.

DESCRIPTION OF THE PREFERRED EMBODIMENT

Figure 1:
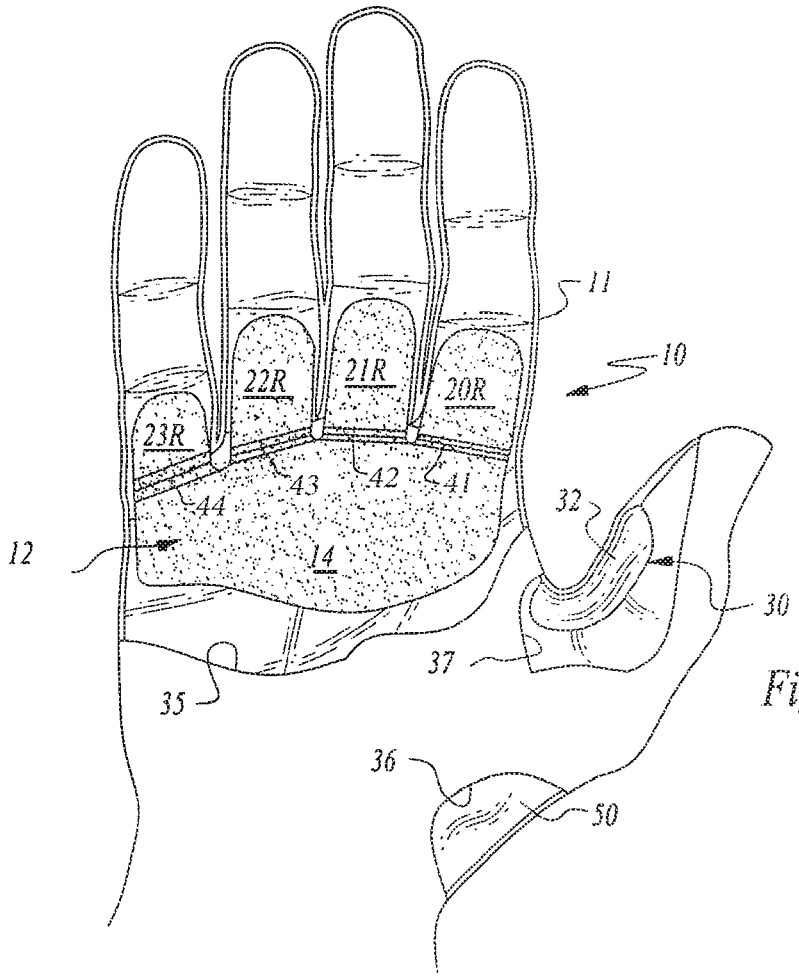
FIG. 1 is a top plan cutaway view of the right ergonomic glove (palmar side) of this invention with the thumb extended, the open position. The left-hand glove is a mirror image thereof.
Figure 7:
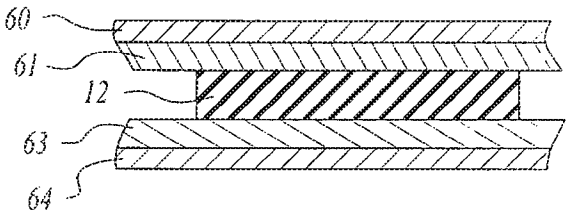
FIG. 7 is a sectional view showing the various layers employed in the manufacture of the glove of this invention, except for the thumb area.

The ergonomic glove 10 of the first embodiment of this invention is seen in FIG. 1. It comprises any standard minimally lined glove 11 having a special insert 12 therein. The insert is seen alone in FIG. 2, the ergonomic glove 10 also includes a thumb retainer 30 to support the thumb. In FIG. 7, a sectional view of the various layers that make up the glove of this invention, but for the thumb area, is seen. Each of these several views will be discussed independently.

Turning now to FIG. 1, a right hand ergonomic fingered glove 10 of this invention is seen. The inventive glove 10 is a cutaway view of the palm side to reveal the contents and to better depict the insert 12 and the standard glove 11 within which the insert is disposed. Thus cutaway lines 35,36,37, indicate the boundaries of the fabric of the standard glove which are retained for identification of the palm side of standard glove 11.

Thumb support 30, also disposed within standard glove 11, will be discussed infra. Thus it is seen that the insert 12 has three portions, the palm portion 14, the intermediate or motion limiting portion 39, seen in detail for all four fingers in FIG. 3, and the finger portion 19 denoted in FIG. 2 of the left hand.

Figure 8:
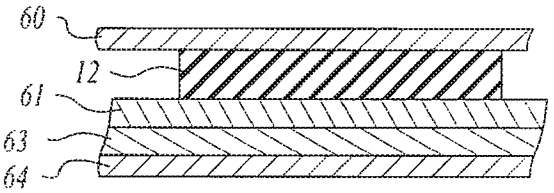
FIG. 8 depicts an alternate construction to that of FIG. 7.

The glove 11 is any standard thinly lined or any unlined glove such as an athletic glove or driving glove. Such a glove can have a leather or artificial leather or other suitable material outer layer such as 60 seen in FIG. 7, an optional fabric lining of cotton or other material 61 for the upper or palm side of the glove, and a similar optional lining 63 and outer layer for the covering of the rear part of the hand 64. The insert 12 is disposed in this FIG. 7 construction between the lining layer 61 and the lining layer 63, and as such comes in direct contact with the hand of the wearer. Whereas in the alternate construction of FIG. 8, the insert 12 is interposed between the outer layer 60 and the lining layer 61.

The insert 12, while a unitary structure formed from a soft polyurethane, flexible foam as noted, possible other materials, could be non-flammable or flame resistant materials such as leather, Kevlar, nomex or soft rubber has three portions. The first is the digit or finger portion 19 which has four sections, one per finger, each of which are designated 20,21,22,23, with an added "L" or "R" designation to denote the left or right-hand version of an insert. The second portion is the intermediate or crease portion 39 which also consists of four sections designated 41, 42, 43, 44, of FIG. 3. The third portion is the palm portion 14 is seen best in FIGS. 1 and 2.

Figure 2:
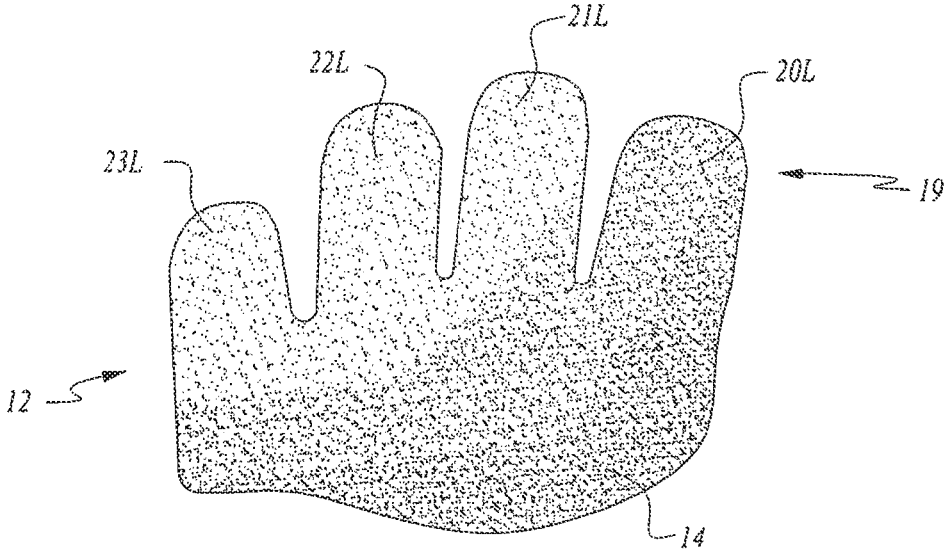
FIG. 2 is a top plan view of the dorsal side of the left-hand foam rubber insert used in the manufacture of the left glove of this invention.

In FIG. 2, the insert 12 is shown for the right-hand glove of this invention. The view here is from the back of the hand as if the hand had been removed from view. Thus, the viewer is above not beneath the insert 12. The finger or first portion 19 covers only the proximal phalanx of each of the four fingers and not the thumb. The four sections here have been designated 20L,21L,22L,23L. The "L" designates that these are for the left-hand unit of the insert forming part of this invention. The right-hand insert would be a mirror image thereof.

Each section of the first portion 19 of the insert 12 extends from about the metacarpophalangeal crease of each finger rearwardly in the direction toward the wrist to the respective inter-digital pad of that finger. Each first portion section may have an arcuate leading edge as shown or one linearly cut if desired.

The intermediate portion of the insert is portion 39 and it too has four sections, one section for each of the respective fingers excluding the thumb. This portion is depicted grossly magnified in the subfigures 3A,3B,3C,3D, of FIG. 3. These four subfigures showing the intermediate sections have been oriented 90 degrees from their in-use position as the correct disposition of the creases is shown in FIG. 1. Each section is a crease between the respective finger and the adjacent palm area.

FIG. 3A represents a side elevational view of the first section which is the crease of the pinky or little finger, fifth metacarpal or fourth finger adjacent to part of the palm area. It is taken along the line 68-68 of FIG. 11. FIG. 3B is the same elevational view of the third finger crease of the insert and that finger and the adjacent palm areas. It is taken along line 69-69 of FIG. 11. FIG. 3C is the same view of the second finger's crease, and is taken along line 70-70 of FIG. 11. While FIG. 3D is of the index finger crease, and is taken along line 71-71 of FIG. 11. All of these creases just mentioned are located adjacent the inter-digital pad of the respective finger. These inter-digital pads are shown in these oriented elevational views.

Each crease 39 comprises two segments depicted here as flat; namely, the first portion of the respective finger and the digital pad or upper area of the palm portion with a crevice there between. From these subfigures, it is to be understood that each crevice in the respective crease of the four fingers of the insert is narrower and shallower in a progression from the little finger toward the thumb. Compare FIG. 3A to FIG. 3D.

Figure 9:
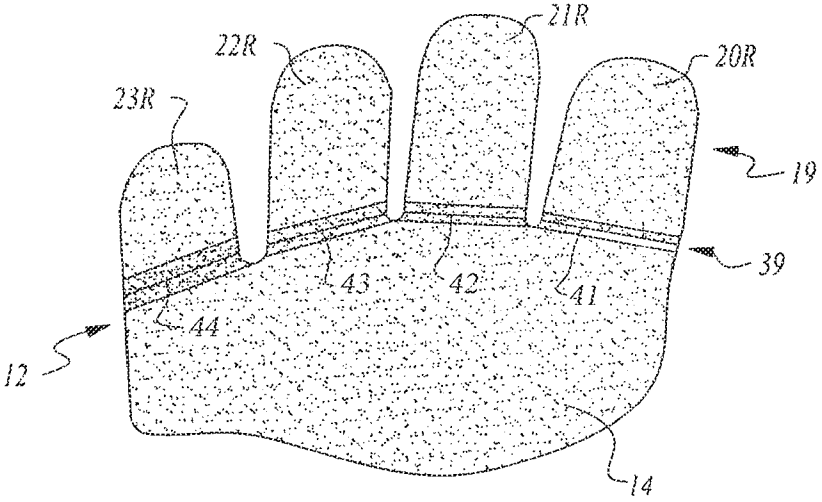
FIG. 9 is a view related to FIG. 2 but of the bottom or palm side of the insert from the right hand.

Reference to the sub-figures shows that the nomenclatures 44U,43U,42U,41U, designators all refer to the upper segment or inclined wall of the respective creases shown in FIG. 1, while 44L, 43L, 42L, 41L, all refer to the lower segment or inclined wall of the respective crease, which lower segments are the mirror image inclined walls between the specific crevice and the respective inter-digital pad. That is, these 41L-44 L's designated surfaces are the inclined walls leading from the first portion to the respective crevice. The crevices of the creases are designated 45,46,47,48, respectively. See FIG. 3. These intermediate sections can be viewed as motion limiters as they restrict the bending of the fingers in differing amounts. Each of these sub-figures was created by slicing through the insert through the palm area to segregate a first portion, one finger and its crease and its part of the palm. Rear edges 39A-39D respectively are shown as jagged in that this line represents an artificial edge in that the cutaway balance of the palm portion is not shown here. Reference to FIGS. 2 and 9 could create some confusion as they both have the same general outline. FIG. 2 is the non-use, that is no crease side or back side of the insert for the left hand. FIG. 9, on the other hand, is the user surface or front side of the insert for the right hand. Note the presence of the creases in the FIG. 9 unit. The third portion of the insert is the palm portion 14. It is a flat, approximately ⅛ to ¼-inch thick, segment of foam rubber, or other material or combination of materials and may be cut or layered, attached to the intermediate portion. It may be flat, shown as a straight line in FIG. 1, at its distal edge IE the edge distant from the fingers or it can be wavelike at the distal edge thereof as shown in FIGS. 2 and 9. The palm portion of the basic insert extends rearwardly from the intermediate creases' portion toward the wrist to an artificial line extending across the hand through the middle of the width of the thumb. But see the discussion infra, concerning FIG. 11 for a more rearwardly distal edge which discussion is set forth subsequent to the discussion of the thumb support. In FIG. 9 as shown, the grooves or channels 41, 42, 43 and 44 are shown slightly angled to the elongation of the fingers. These grooves may also be straight across. IE about 90 degrees to the elongation of the fingers.

The reader is again referred to FIG. 1 as the discussion now turns to the thumb support 30. This element is a flexible plastic or other material member having a wavelike configuration and having an arched over segment. This element is somewhat upstanding in its vertical disposition. Bottom surface 31, per FIG. 11, adjacent the thumb is concave in its lateral disposition to conform to the convex shape of the thumb. Surface 31 slightly encircles the thumb to retain it in the desired position on the support 30.

Figure 10:
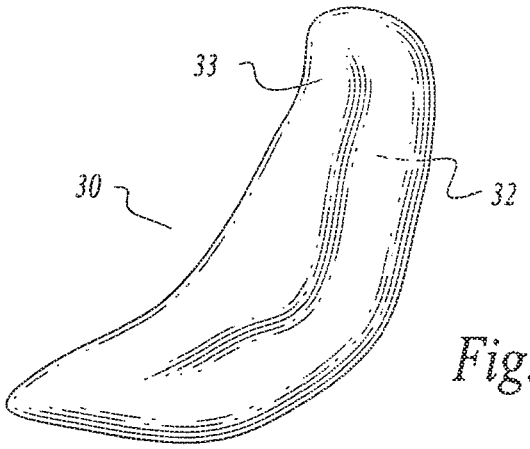
FIG. 10 is a left perspective view of the thumb retainer of a right-hand glove of this invention as seen from the palmar side.

The bottom surface 31 supports the thumb both slightly above and slightly below the crease between the distal and proximal phalanxes of the thumb. Reference should also be made to FIG. 10 because the discontinuous arched over segment 33 seen there provides stabilization for the thumb, and which segment is hidden from view in FIG. 1. This arched over segment 33 extends somewhat transversely to the support bottom surface 31 and engages the side of the gripping thumb. Basically we are modifying the at rest position of the thumb to help locate and maintain the gripping thumb in the desired comfortable angled and bent position. It should be noted that the support 30 seen in FIG. 10 is for the right-hand thumb and as such, from the perspective of FIG. 1, the discontinuous arched over segment cannot be seen. The side aspect of support 30 is designated 32. See FIG. 10.

Support 30 may be made of a flexible material such as nylon or other polyamide thus the thumb while supported is able to articulate. Support 30 is sewn or glued in place between the lining and the outer layer of the conventional glove 11. If the glove 11 is unlined, support 30 may be attached by a suitable adhesive to retain it in its desired position.

Figure 6:
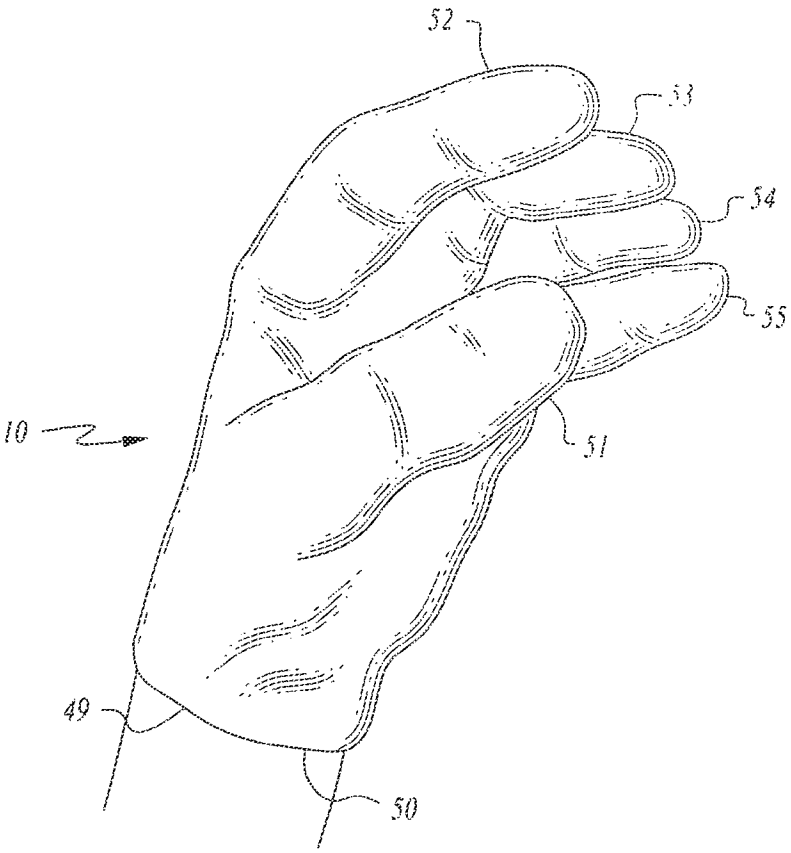
FIG. 6 is a view of the left-hand glove slightly more rotated than in FIG. 4 wherein the middles of the fingers of the glove—a portion of the glove that constitutes an area of the glove that provides no support structure, have been cut off.

FIGS. 4-6 are provided to show the hand as it will be seen when stowed within the ergonomic glove 10 of this invention. The thumb of the glove 10 is designated 51 and the respective fingers 52-55 inclusive. In FIG. 6, a so-called short glove in that it has no rear ribbing and does not extend over the wrist, the rear edge 49 is seen and the arrow points to hand 50 disposed therein. As can be seen that the hand 50 is supported within the glove 11 by the insert 12 to achieve the curvature as shown in the several perspective points of FIGS. 4-6.

The insert 12 in FIG. 7 is disposed in this construction between the lining layer 61 and the lining layer 63, and as such comes in direct contact with the hand. Whereas in the alternate construction of FIG. 8, the insert 12 is interposed between the outer layer 60 and the lining layer 61.

FIG. 9 has already been referred to in brief. It is the front side of the insert in its entirety and shows the exact locations of the creases previously discussed.

Figure 11:
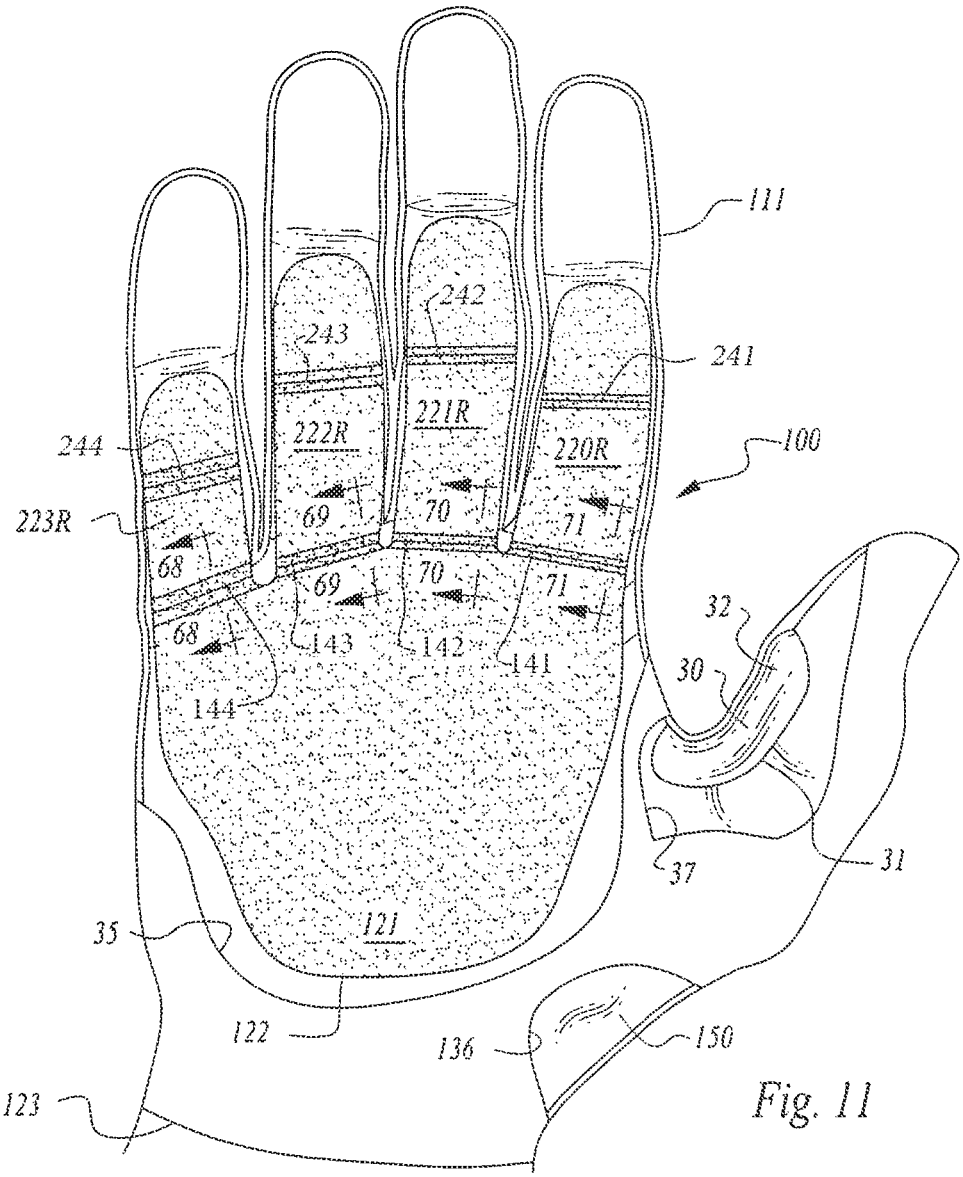
FIG. 11 is a view similar to FIG. 1 in that it illustrates two variants that may be incorporated into the glove shown in FIG. 1.

While only one hand has been discussed and only one inventive glove shown for this first embodiment, it is best if the glove of this invention is used in matched pairs, one for the right hand and one for the left hand. That way maximum benefit is obtained. The second embodiment should also preferably be used in pairs The glove shown in FIG. 11 is a cutaway of a composite glove based on the glove 10 of FIG. 1. Here glove 100 of the invention utilizes the basic insert 12 shown in FIG. 2 to which sections have been added and as such the insert is now designated 120. The basic glove upon which the invention has been incorporated is now designated 111. The first feature addition to be discussed is the palm area extended padding 121. This can be extended to the amount desired depending upon the configuration of the glove from the rear edge 122 as shown all the way to the very rear edge 123 of the glove thereof as may be desired. The cutaway line 136 yields the hypothenar area 150 to the rear of the right thumb in this figure.

The second feature addition shown in this FIG. 11 can be added separately or in conjunction with the first feature addition. The second feature pertains to an extension of each of the finger sections of the finger portion of insert 120 such that a second set of creases similar in design and sizing as the first set of creases described infra can be had. The placement of this second set of creases is disposed at a location that approximately corresponds to the metacarpophalangeal crease of each finger of a wearer. These second creases are respectively designated 243,242,241,240. The nomenclature for the lower and upper aspects has been retained as is apparent from FIG. 11. The lower creases of the dual crease embodiment are designated 143,142,141, 140, respectively. See FIG. 11.

Applicant is the inventor of U.S. Pat. No. 5,979,015 issued Nov. 9, 1999. That patent pertained to a pair of handgrips. The channels of the insert of this ergonomic glove, as disposed in the palm of the glove, create the same effect upon the handgrips as the fingers contract during the course of work as occurs when the fingers are placed upon a set of the grips or upon the grips as incorporated into other structures such as ski poles or hand tools. As the hand wraps around the grip, the fingers and thumb are placed or guided to precise positions relative to the grip but now within the glove as the ergonomic glove is wrapped around a work surface.

1. The thumb shelf which supports the thumb in a bent position:

a) Keeps the metacarpal and phalanges from being displaced by drawing the bones back to a neutral position. When the thumb is in an extended position, the metacarpal acts as a lever and shifts the bones of the hand and wrist out of a neutral alignment creating ulnar deviation.

b) Keeps the hand from over pronation (rotating inward). The extended thumb initiates independent pronation of the hand causing the wrist and elbow to move in an opposing direction IE the hand rotates inward and the elbow wants to rotate away from the body.

c) Helps hold the bones of the hand on a single plane. This allows the fingers to contract in a linear pattern otherwise the fingers twist as they are contracted. The extended thumb also causes the wrist and hand to hyperextend.

Further, the glove is designed to support the fingers to facilitate the desired generally neutral positioning of the hand relative to the associated forearm. In this regard, it is desirable that the hand be generally aligned with the adjacent forearm.

The hand is generally aligned or coplanar (rather than cocked) with regard to the adjacent surface of the forearm as seen in FIGS. 4-6. The hand in neutral resting position is coplanar when and as activities are performed. The wrist is aided and stabilized by the features of the glove and the hand can still be articulated to various positions that are determined by the activity being performed.

It is seen that the plastic support for the thumb retains the thumb such that the thumb, index finger (first finger), and the wrists are placed in a neutral or stable position during use of the glove of this invention. Since the padding provided by the insert's second portion—that is at the crevice of the crease, is smaller at the index and middle fingers than at the third and fourth fingers, contraction of the fingers is less restricted at the little finger and ring fingers (fourth and third fingers) than at index and second fingers. The flexibility decreases from the fourth finger toward the index finger. That is the fourth is less restricted than the index to bending. The thumb support may also be made of flame resistant material for special needs.

While a full glove is the best mode of utilizing this invention, the middle of the fingers of the glove may be cut off without inhibiting the benefits to be gained from the invention as the tips of the fingers of the glove are positioned forward of the insert and forward of the thumb retainer 30 used to support the thumb. Thus fingerless gloves are fully contemplated.

Figure 12:
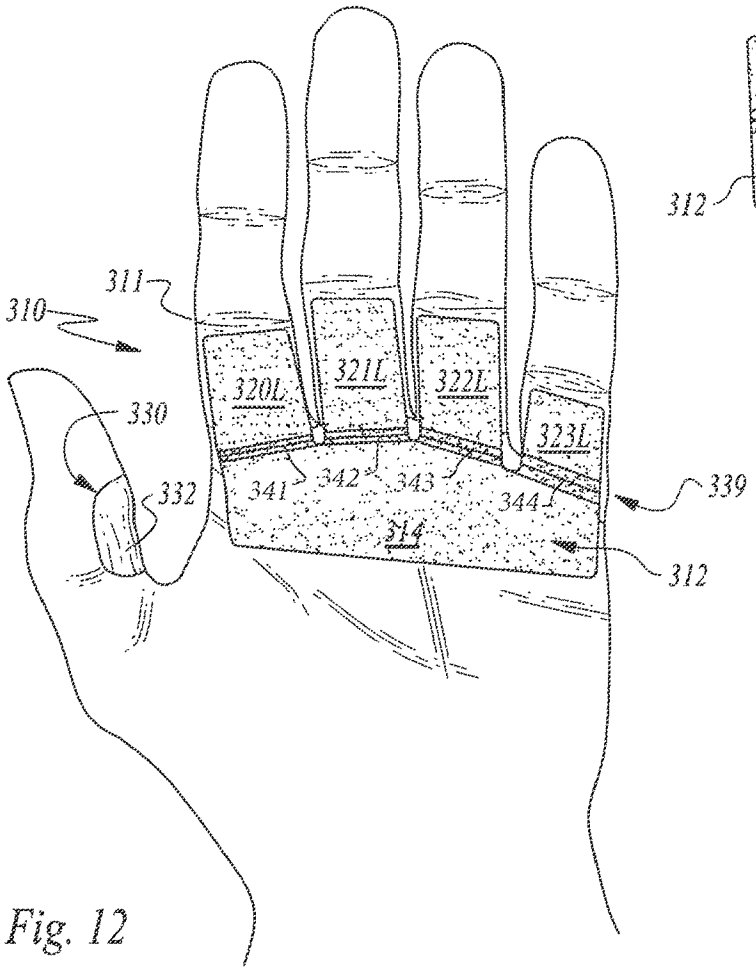
FIG. 12 is a top plan view of the left hand glove of the second embodiment of this invention with the thumb extended, that is, in the open position. The right hand glove is a mirror image thereof. The view shown is palmar side.

Thus reference is made to FIG. 12 wherein a glove of the second embodiment can be seen. The second embodiment comprises any standard minimally lined glove 310 having a special insert, previously discussed therein and her referred to as 310. The insert 312 as noted above is seen alone in FIG. 13 and is squared off at the end of each digit portion, as opposed to being rounded as per other FIGURES. The ergonomic figered version 310 and the fingerless glove 360 also includes a thumb support 332 to support the thumb. Also in FIG. 7, a sectional view of the various layers that make up the fingered glove of this invention, but for the thumb area, is seen. The fingerless version of the second embodiment is of the same construction. Each of these several views has been discussed. By the term "fingerless" for the purpose of this invention, I mean a glove wherein the tips of the fingers and the tip of the thumb have been cut off at a specific location as recited infra.

The discussion now turns to FIG. 12 where is seen the left hand ergonomic fingered glove 310 of this second embodiment of the invention. Since the right hand fingered glove is a mirror image, it will not be specifically discussed. The inventive glove 310 is an x-ray view of the palmar side of any standard glove 311, to reveal the contents and to better depict the insert 312 of FIG. 13. The fingerless glove version 360 wherein the insert is disposed externally and designated an exsert 360 will be discussed with respect to FIG. 14. The term x-ray view is used for FIG. 12, since no cutaway lines are used to indicate the boundaries of the fabric of the standard glove, be it fingered or fingerless.

Thumb support 330 which has a side portion 332 in FIG. 12, also may be disposed externally on glove 360, will be discussed infra and is referred to as an exsert. Note the use of the designator L in FIG. 12 and R in FIG. 14 for left and right handed.

Figure 13:
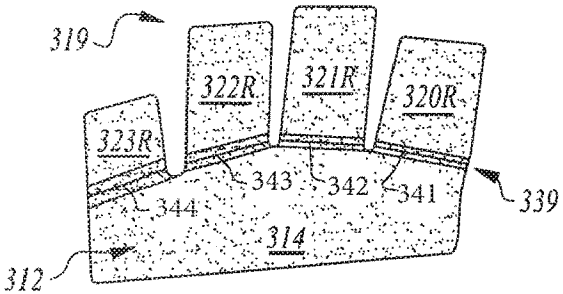
FIG. 13 is a top plan view of an alternately constructed insert for use in this invention, palm side.

Thus it is seen that the insert 312, seen in FIG. 13, whether mounted internally or externally has three portions, the palm portion 314, the intermediate or motion limiting portion 339, seen in detail for all four fingers in FIG. 3, and the finger portion 319, all of which have been discussed supra though with different reference number series. One can readily see the distinction in the palm portion 314 versus the palm portion 14 of the first embodiment as to its configuration.

Figure 14:
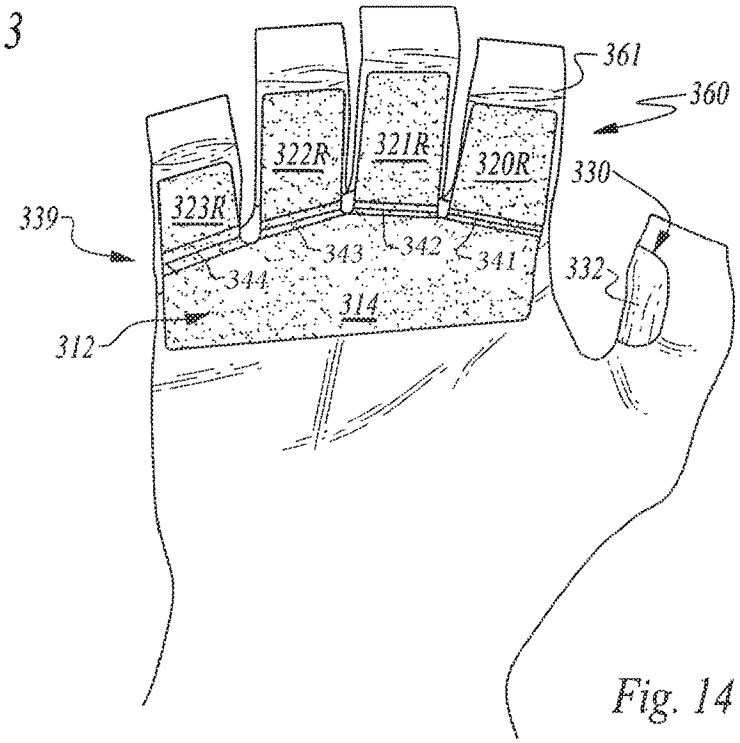
FIG. 14 is a top plan view of the insert of FIG. 13 externally mounted and designated an exsert, palmar side.

The fingerless glove 361 of FIG. 14 is any standard thinly lined or any unlined glove such as an athletic glove or driving glove. Such a glove can have a leather or artificial leather outer layer, an optional fabric lining of cotton or other material for the upper or palm side of the glove, and a similar optional lining and an outer layer for the covering of the rear part of the hand, as has been noted in the discussion of FIGS. 7&8. The insert 12 previously discussed in FIG. 7 is disposed in this construction between the lining layer 61 and the lining layer 63, and as such comes in direct contact with the hand. Whereas in the alternate construction of FIG. 8, the insert 12 is interposed between the outer layer 60 and the lining layer 61. Such alternative placements also apply to the second insert 312.

Here in FIG. 12, the insert 312, while a unitary structure formed from a soft polyurethane, flexible foam as noted, has three portions. The first is the digit or finger portion 319 which has four sections, one per finger, each of which are designated 320,321,322,323, with an added "L" or "R" designation to denote the left or right-hand version of an insert. The second portion is the intermediate or crease portion 339 which also consists of four sections designated 341,342,343,344, of FIG. 13. The third portion is the palm portion 314 is seen best in FIGS. 12 and 14. Further discussion concerning the insert for the second embodiment is not needed as the insert is the same insert as used in the first embodiment, though slightly different shaped at the end of the plurality of finger portions.

If one considers the point of attachment of each finger and the thumb respectively to be the first "crease," or bend point, the fingers of glove 360 should be cut off at or about the second or middle crease of each finger and the distal crease of the thumb to be designated fingerless for the purpose of this invention. This will permit a full bending of all of the fingers and the thumb with no impediment. Thus the insert 312 should be located such that no part of the insert extends beyond the cut off edge of each finger and the thumb in glove 311. To ensure long wear, the edge of each finger opening and the edge of the thumb opening should be circularly stitched.

One might inquire as to for whom is this fingerless glove 360 of this second embodiment is intended. Runners and hikers who want to run or jog while holding the patented grips of applicant will have full use of their fingers to hold onto their water bottles. Gardeners will find them ideal for using shovels, spades and other garden tools in a safer mode. Cab drivers, and typists are good candidates for use of this second embodiment, since the fingers need to grip the steering wheel or be able to specifically impact a specific key on a keyboard. The effect that is to be achieved is to stabilize the body while aligning the skeletal frame specifically the fingers, hands, wrists, forearms, shoulders and back while using one's hands in a working position by holding, grasping, turning, rotating etc, namely every motion that the hand and fingers can make. The movement of the arms and the positioning of the hands on the tool or implement affects the position and the stabilization of the body from the waist down. The body reacts to hand and arm actions, laterally elevating your arm with palms down increases the amount of lateral torso and head angulations as opposed to turning the palms up while laterally elevating an arm. Thus the saying, A stable body is a healthy body.

Previously with respect to insert 12 shown in FIGS. 1 and 3, it has been mentioned that the insert is formed of rubber or soft polyurethane into which creases have been cut of varying sizes in the finger portion. The same holds true here for this second embodiment.

It has now been found that the desired progressive contraction pattern of the fingers where the little finger is easiest to contract, IE fold over toward the wrist, can be achieved by utilizing a plurality of layers of material, glued, heat welded, sewn or a combination of these procedures, to create a variable resistance pattern from the $5^{th}$ finger down to index finger.

The readers attention is directed to FIG. 13, which shows such an insert 312.

Here also the first portion 319 of the insert 312 extends from about the meta carpophalangeal crease of each finger rearwardly toward the wrist, to the specific inter-digital pad of that particular finger. Each first portion may have an arcuate leading edge, or be linearly cut for a no finger tip glove, if such desired. The construction is the differing point.

FIG. 14 is a perspective view slightly to the palmar side of this right handed fingerless glove, 360, wherein the insert 312 is mounted on the outside of the glove as an addition, and designated an exsert, 312, as by gluing, sewing or heat welding, depending upon the material employed for both the glove and the exsert. This exsert is structurally the same as the insert 312, just relocated. It is composed of a plurality of layers of urethane adhesive, readily available at the marketplace. The buildup of layers achieves the same result as cutting grooves into the uniformly thick material employed for insert 12. Thus in the enlarged FIG. 14, the fifth finger 323R has 4 layers of uniform thickness, while finger 322R has 3 layers of the same thickness as finger 323 R, and one thin layer. The middle finger 321R is the same as 322R but omits the one thin layer. While index finger 320R has but two layers.

Rather than the groove pattern as shown the several views of FIG. 3, only a single cut of about 1/16th inch exists between the finger portion 319 and the palm portion 314 of this exsert. Of course the exsert 312 can be placed interiorly of the glove for direct contact with the fingers, or it can be inserted in a liner to avoid direct finger contact as may be desired. In such case element 312 would be designated an insert.

The use of the layering technique to achieve the contraction results desired permits non-flammable materials such as Kevlar® to be employed for the benefit of fire fighters, glass makers and fighter pilots.

The thumb support 330 to be employed with the exsert 312 may be similarly constructed to the thumb support 330 and it too can be fashioned from fire resistant material such as carbon fiber, for high heat environment usage. Here in FIG. 12 the thumb, when at rest is placed in a position quite similar to its position of support on applicant's patented hand grips aforementioned. But the support here in the glove is adequately flexible to permit the thumb to move for grasping motion when needed. When used externally as in FIG. 14, the thumb support 330 may be glued into position, or retained by a cloth wrapper having an adhesive underside that sticks to the fabric.

Of course the exsert 312 can be used on a fingerless glove as well as a fingered one is not specifically depicted.

Figure 15B:
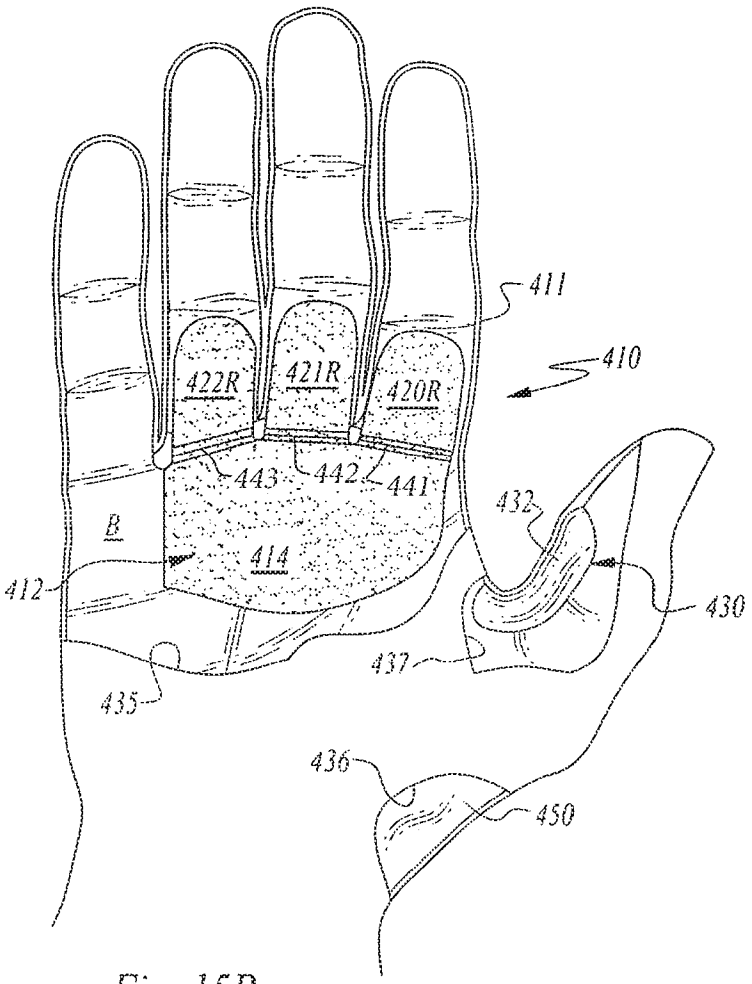
FIG. 15B is an alternate form of the variant of the device of FIG. 15A.
Figure 15A:
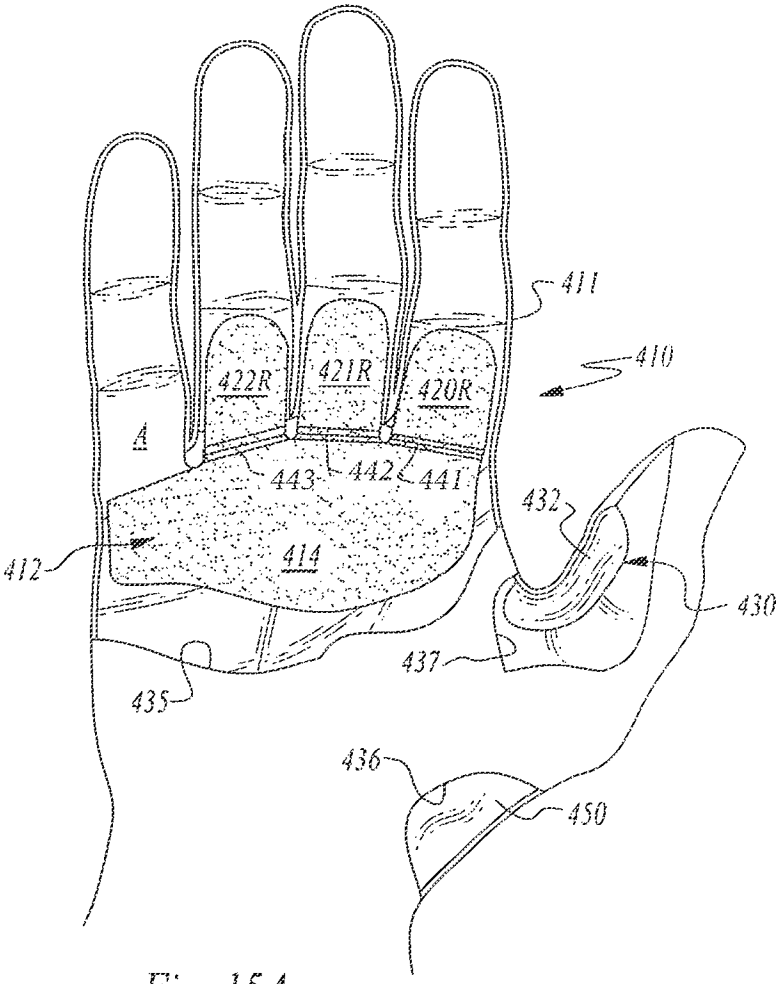
FIG. 15A is a variant of the glove of this invention.

In FIG. 15A a variant of the glove of this invention is seen. While only the right hand glove is shown, the discussion applies equally to one or both gloves. In this variant the padding designated "A" for the little or $5^{th}$ finger has been removed. In FIG. 15B, not only the portion designated "A" has been removed, but also the portion designated "B", which is padding in the palm area, situated just below the "A" portion has also been removed. It has been found that in both instances, the benefits of wearing of the glove(s) is still retained. Attempts to remove padding in the finger and/or palm area at the locations of other fingers is detrimental and counterproductive to the benefits to be gained from use of the glove for all activities. For ease and convenience the general numbering of parts as used earlier herein has been retained, but 1 hr these two figures, FIGS. 15A & 15B, the numbers have been placed in the 400 series.

Observations

By using the glove of this invention, the hand is placed into a position wherein the radio-ulna line is in neutral alignment thus avoiding tendinitis and other hand and/or wrist injuries. The contraction pattern of the fingers, when this glove is used, brings about a tighter contraction pattern of the little finger and ring finger to thereby create greater muscular use of the triceps and posterior deltoid muscles, the result of which is to stabilize the pectoral girdle and back, and which keeps the shoulders from internally rotating thereby maintaining spinal alignment.

By a wearer using the gloves of this invention, preferably in pairs, the wearer's biomechanical efficiency is improved due to the retention and support of the thumb in a neutral position and restriction of the contraction of the fingers on a graduated basis.

Any suitable material may be employed for the outer layers of the fingered and fingerless gloves of this invention, such as leather, suede, vinyl, latex rubber, nylon, or fabrics such as cotton, linen, and wool, Kevlar and Nomex. The optional linings may be a knit fabric or other suitable lining material such as lamb's wool or rabbit hair.

It has been observed that the user of the gloves of this invention have their balance affected positively when wearing the gloves of this invention be the gloves, with or without fingers. It is well known that the skeleton is made up primarily of small bones and a few big ones. The key to balance in one's gait and in standing erect is the position of the shoulders. If the shoulders are straight, the spine will retain its desired upright position. When the spine is misoriented, one loses their balance.

It has been observed that when a wearer Mr A, has on the gloves and is engaged in an arm curl exercise with another person Mr B, of superior strength, who is not wearing the gloves, that it will be quite difficult for Mr. B to cause the wearer Mr. A to move from a given normal stance. Without the gloves on, Mr. B can move the wearer Mr. A quite easily.

In another exercise, when the wearer has the gloves on, and assumes an elbows by the side palms up stance with the gloves in place, a poke on the chest or push by Mr. B will NOT cause the wearer Mr. A to step back. But with out the gloves and the arms in the exact same position, elbows in, palms up, Mr. B's poke or push can easily cause the wearer to take a step backwards.

If wearer Mr. A without the gloves on, were to take a Phillips or other screwdriver, and practice a few turns on a screw using the right hand, it will be observed that when the wearer works strenuously, the right shoulder becomes arched. This eventually can cause joint discomfort if these rotational movements are carried out for a long period of time. But when the glove is worn on at least the hand using the screwdriver, it is found that the shoulder of the hand with the glove does not rise, thus avoiding potential injury, and assuring proper stance of the wearer.

In essence the wearing of the gloves by workers can help them to maintain a physical alignment that is conducive to the performance of tasks with reduced injuries, and greater ease. Thus the gloves are recommended for package delivery people such as FedEx®, post office and UPS workers, construction personnel, and ditch diggers/gardeners among others.

The reader should further understand that the human skeleton is made up mostly of small bones. The wearing of the gloves tends to stabilize the alignment of the back and thus retain these small bones in the correct position relative to each other. The shoulders of the person are the keystone to [proper posture. If on going about certain chores, such as lifting or carrying of an item(s), the shoulders rotate or move, such movement causes the spine to change the position of the basis for your balance—so that you don't fall over—since the body reacts to the orientation of the spine.

For example, if a person carries out rotation of the arm during the use of a manual screwdriver, the shoulder on the right side of the body rises and falls. But where the gloves of this invention are worn, and the same job is performed, the shoulder stays level, such that after many repetitions of screwing in screws, during the assembly of an item, joints on the right side of the body that would have ached without glove wearing, do not ache.

To reiterate what was alluded to above, the gloves of this invention can be made of a variety of materials to suit the job of the wearer. Thus Kevlar® fabric, for fire fighters, leather for those persons pulling weeds, or working in thorny plant areas along the nations highways or in fields, cotton for use in "clean rooms" for semiconductor production, and wool for persons subject to cold temperatures are but a few of the fabrics that can used for the gloves of this invention. The materials suitable for the padding has been discussed supra.

Since certain changes may be made in the described apparatus without departing from the scope of the invention herein involved, it is intended that all matter contained in the above description and shown in the accompanying drawings shall be interpreted as illustrative and not in a limiting sense.

I claim:

1. An ergonomic glove comprising:

a thumb support including:

a bottom surface adapted to extend across distal and proximal phalanges of a thumb of a human wearing the ergonomic glove, wherein the bottom surface is concave in lateral disposition configured to form a convexity of the thumb while adapted to partially encircle the wearer's thumb;

a side portion;

an arched over segment extending transversely to the bottom surface and adapted to engage the thumb on a side closest to the metacarpophalangeal crease of an index finger portion adjacent to the thumb;

an insert including:

a palm portion;

four finger portions, one for each of four fingers, wherein the four finger portions include an index finger portion, a middle finger portion, a ring finger portion and a little finger portion;

an intermediate portion comprising four creases, one for each respective finger portion, wherein each crease includes a crevice, one for each respective finger portion, wherein from the little finger portion toward the index finger portion, the crevice for each respective finger portion gets shallower.

2. The glove of claim 1 wherein the thumb support is made of a flexible plastic to permit the wearer's thumb to articulate while being supported.

3. The glove of claim 2 wherein the glove is unlined and the thumb support is attached to the glove by application of an adhesive.

4. The glove of claim 2 wherein the glove is lined and the thumb support is sewn in place between an outer layer and said lining.

5. The glove of claim 2 wherein the glove is lined and the lining has an inner face and an outer face, and the thumb support is attached to the glove by application of an adhesive to the inner face of the lining.

6. The glove of claim 1 wherein the palm portion includes extended padding and is adapted to extend rearwardly toward a hypothenar area of the thumb support, and further wherein the four finger portions are extended in a direction away from the palm portion and each respective finger portion includes a second crease adapted to be disposed at a location corresponding to about the metacarpophalangeal crease of each respective finger.

7. The glove of claim 1, wherein the glove's finger portions are open ended such that the wearer's fingers may protrude therethrough.

8. The glove of claim 1 wherein the insert and the thumb support are both mounted externally on the glove.

9. The glove of claim 1 wherein the thumb support is made of flexible plastic.

10. An ergonomic glove comprising:

an insert having three portions:

four finger portions for covering of the proximal phalanx of each of four fingers of a human wearing the ergonomic glove, wherein the four fingers do not include a thumb of the human wearing the ergonomic glove and wherein the four finger portions include an index finger portion, a middle finger portion, a ring finger portion and a little finger portion;

an intermediate portion for covering creases at a junction with a palm portion of the ergonomic glove wherein the intermediate portion of the insert includes four sections, wherein each of the four sections is disposed between the palm portion and each of a respective finger portion; and the palm portion, wherein each section of the intermediate portion includes a crease, each crease comprising two segments with a crevice therebetween and the crevice of the creases being narrower and shallower from the little finger portion in a progression toward the index finger portion;

a thumb support, including a bottom surface configured to extend across distal and proximal phalanges of the thumb when the ergonomic glove is worn by a human, wherein the bottom surface is concave in lateral disposition configured to partially encircle the thumb of the human wearing the ergonomic glove.

11. The glove of claim 10 wherein the finger portion and intermediate portion of the insert each have four sections, one section adapted to correspond to the four fingers and wherein each section of the finger portion is adapted to extend from the metacarpophalangeal crease of its respective finger to the respective inter-digital pad of that finger.

12. The glove of claim 10 wherein each section of the intermediate portion of the insert is adapted to be located adjacent an inter-digital pad of the respective finger.

13. The glove of claim 10 wherein the palm portion includes a distal edge, wherein the distal edge of the palm portion is a straight line.

14. The glove of claim 10 wherein the palm portion includes extended padding and is adapted to extend rearwardly toward a hypothenar area of the thumb support.

15. The glove of claim 10 wherein the finger portion is configured to extend in a direction away from the palm portion and each respective finger portion includes a second crease adapted to be disposed at a location corresponding to about the metacarpophalangeal crease of each respective finger portion.

16. The glove of claim 10, wherein the glove's finger portions are open ended such that the wearer's fingers may protrude therethrough.

17. An ergonomic glove comprising:

four finger portions, one for each of four fingers, wherein the four finger portions include an index finger portion, a middle finger portion, a ring finger portion and a little finger portion;

a thumb support including:

a bottom surface adapted to extend across distal and proximal phalanges of a thumb of a human wearing the ergonomic glove, wherein the bottom surface is concave in its lateral disposition configured to form a convexity of the thumb while adapted to partially encircle the wearer's thumb;

a side portion;

an arched over segment extending transversely to the bottom surface and adapted to engage the thumb on a side closest to a metacarpophalangeal crease of the index finger portion adjacent to the thumb;

an insert, said insert having three portions:

an intermediate portion, wherein said intermediate portion comprises four creases, one for each respective finger, wherein each crease includes a crevice, one for each respective finger, wherein from the little finger portion toward the index finger portion, the crevice for each respective finger portion gets shallower;

a palm portion, wherein the palm portion extends rearwardly from the intermediate portion adapted to extend across the hand through the middle of the width of the thumb, and further a distal edge of the palm portion is in configuration such that when an item is gripped by the human wearing the ergonomic glove, the thumb support is bent, and the hand and wrist are adapted to maintain a neutral position aligned with the human's forearm.

18. The glove of claim 17 wherein the palm portion includes extended padding adapted to extend rearwardly toward a hypothenar area of the thumb support, and further wherein the finger portion is extended in a direction away from the palm portion.

19. An ergonomic glove having palm and finger portions, including:

an externally mounted thumb support including:

a bottom surface adapted to extend across distal and proximal phalanges of a thumb of a human wearing the ergonomic glove, wherein the bottom surface is concave in lateral disposition configured to form a convexity of the thumb while adapted to partially encircle the wearer's thumb;

a side portion;

an arched over segment of said support being upstanding in its vertical disposition;

an externally mounted exsert having three portions:

a palm portion;

an intermediate portion; and four finger portions wherein said intermediate portion has varying depth cuts between each of the four finger portions and the palm portion to achieve a progressive restrictive contraction pattern, wherein the four finger portions include an index finger portion, a middle finger portion, a ring finger portion and a little finger portion, with the little finger portion being easiest to contract, wherein the externally mounted exsert comprises padding.

20. The glove of claim 19 wherein said exsert is formed as a unitary flexible foam structure wherein the palm portion and the intermediate portion of the exsert each have four sections, one corresponding to each finger portion and wherein each section of the palm portion is adapted to extend from a metacarpophalangeal crease to the respective inter-digital pad of the finger portion and the palm portion is adapted to extend across the ergonomic glove through the middle of the width of the thumb support.

21. The glove of claim 19 wherein the exsert is formed of foam polyurethane.

22. The glove of claim 19 wherein the progressive restrictive contraction of the respective finger portion is achieved by using a plurality of layers of material for each finger portion, the sum of the thicknesses of the layers being thickest for the index finger portion and thinnest for the little finger portion, whereby bending of the little finger portion is least difficult and bending of the index finger portion is relatively hardest.

23. The glove of claim 22, wherein said palm portion includes a non-arcuate palm portion.

24. The glove of claim 19 wherein the glove's finger portions are open ended such that the wearer's fingers may protrude therethrough.

25. The glove of claim 19 wherein there is no padding for the little finger portion.

26. The glove of claim 19 wherein there is no padding for the palm portion beneath the little finger portion.

27. The glove of claim 19 wherein there is no padding of both the little finger portion and the palm portion beneath the little finger portion.

* * * * *